US008479823B2

(12) United States Patent
Mireles

(10) Patent No.: US 8,479,823 B2
(45) Date of Patent: Jul. 9, 2013

(54) PLUG COUNTER AND METHOD

(75) Inventor: Hector H. Mireles, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 684 days.

(21) Appl. No.: 12/564,539

(22) Filed: Sep. 22, 2009

(65) Prior Publication Data

US 2011/0067888 A1 Mar. 24, 2011

(51) Int. Cl.
*E21B 34/00* (2006.01)

(52) U.S. Cl.
USPC ..... 166/332.2; 166/318; 166/331; 166/373

(58) Field of Classification Search
USPC ..... 166/331, 332.2, 332.3, 318, 373
See application file for complete search history.

(56) References Cited

U.S. PATENT DOCUMENTS

| | | | | |
|---|---|---|---|---|
| 1,883,071 | A | | 12/1928 | Stone |
| 2,769,454 | A | | 11/1956 | Bletcher et al. |
| 2,812,717 | A | | 11/1957 | Brown |
| 2,822,757 | A | | 2/1958 | Colberly |
| 2,973,006 | A | | 2/1961 | Nelson |
| 3,007,527 | A | | 11/1961 | Nelson |
| 3,013,612 | A | | 12/1961 | Angel |
| 3,148,731 | A | | 9/1964 | Holden |
| 3,211,232 | A | | 10/1965 | Grimmer |
| 3,263,752 | A | | 8/1966 | Conrad |
| 3,358,771 | A | | 12/1967 | Berryman |
| 3,510,103 | A | | 5/1970 | Carsello |
| 3,566,964 | A | | 3/1971 | Livingston |
| 3,667,505 | A | | 6/1972 | Radig |
| 3,703,104 | A | * | 11/1972 | Tamplen ..... 74/88 |
| 3,727,635 | A | | 4/1973 | Todd |
| 3,797,255 | A | | 3/1974 | Kammerer, Jr. et al. |
| 3,901,315 | A | | 8/1975 | Parker et al. |
| 3,954,138 | A | | 5/1976 | Miffre |
| 3,997,003 | A | | 12/1976 | Adkins |
| 4,067,358 | A | | 1/1978 | Streich |
| 4,160,478 | A | | 7/1979 | Calhoun et al. |
| 4,176,717 | A | | 12/1979 | Hix |
| 4,190,239 | A | | 2/1980 | Schwankhart |
| 4,246,968 | A | | 1/1981 | Jessup et al. |
| 4,260,017 | A | | 4/1981 | Nelson et al. |

(Continued)

FOREIGN PATENT DOCUMENTS

| | | |
|---|---|---|
| EP | 0427422 A2 | 5/1991 |
| GB | 2281924 | 3/1995 |
| WO | 00/15943 | 3/2000 |

OTHER PUBLICATIONS

International Search Report and Written Opinion of the International Searching Authority; PCT/US2010/044378; Mailed Mar. 17, 2011.

(Continued)

*Primary Examiner* — Shane Bomar
*Assistant Examiner* — Kipp Wallace
(74) *Attorney, Agent, or Firm* — Cantor Colburn LLP

(57) ABSTRACT

A plug counter including a j-slot sleeve; a helix sleeve in operable communication with the j-slot sleeve such that axial movement of the j-slot sleeve causes rotational movement of the helix sleeve; an anti-rotation sleeve disposed about the helix sleeve and having a keyway therein; and a key disposed in the keyway and responsive to movement of the helix sleeve and method.

15 Claims, 3 Drawing Sheets

U.S. PATENT DOCUMENTS 4,291,722 A 9/1981 Churchman
4,292,988 A 10/1981 Montgomery
4,355,685 A 10/1982 Beck
4,390,065 A 6/1983 Richardson
4,448,216 A 5/1984 Speegle et al.
4,474,241 A 10/1984 Freeman
4,478,279 A 10/1984 Puntar et al.
4,537,383 A 8/1985 Fredd
4,554,981 A 11/1985 Davies
4,566,541 A 1/1986 Moussy et al.
4,576,234 A 3/1986 Upchurch
4,583,593 A 4/1986 Zunkel et al.
4,669,538 A 6/1987 Szarka
4,711,326 A 12/1987 Baugh et al.
4,714,116 A 12/1987 Brunner
4,729,432 A 3/1988 Helms
4,823,882 A 4/1989 Stokley et al.
4,826,135 A 5/1989 Mielke
1,856,591 A 8/1989 Donovan et al.
4,856,591 A 8/1989 Donovan et al.
4,893,678 A 1/1990 Stokley et al.
4,944,379 A 7/1990 Haaser
4,979,561 A 12/1990 Szarka
5,029,643 A 7/1991 Winslow et al.
5,056,599 A 10/1991 Comeaux et al.
5,230,390 A 7/1993 Zastresek et al.
5,244,044 A 9/1993 Henderson
5,297,580 A 3/1994 Thurman
5,305,837 A * 4/1994 Johns et al. ..... 175/61
5,335,727 A 8/1994 Cornette et al.
5,343,946 A 9/1994 Morrill
5,529,126 A * 6/1996 Edwards ..... 166/331
5,609,178 A 3/1997 Hennig et al.
5,704,393 A 1/1998 Connell et al.
5,762,142 A 6/1998 Connell et al.
5,775,421 A 7/1998 Duhon et al.
5,775,428 A 7/1998 Davis et al.
5,813,483 A 9/1998 Latham et al.
5,960,881 A 10/1999 Allamon et al.
6,050,340 A 4/2000 Scott
6,053,250 A 4/2000 Echols
6,079,496 A 6/2000 Hirth
6,102,060 A 8/2000 Howlett et al.
6,155,350 A 12/2000 Melenyzer
6,173,795 B1 1/2001 McGarian et al.
6,220,350 B1 4/2001 Brothers et al.
6,227,298 B1 * 5/2001 Patel ..... 166/321
6,253,861 B1 7/2001 Carmichael et al.
6,293,517 B1 9/2001 Cunningham
6,378,609 B1 * 4/2002 Oneal et al. ..... 166/278
6,474,412 B2 11/2002 Hamilton et al.
6,530,574 B1 3/2003 Bailey et al.
6,547,007 B2 4/2003 Szarka et al.
6,634,428 B2 10/2003 Krauss et al.
6,644,412 B2 11/2003 Bode et al.
6,666,273 B2 12/2003 Laurel
6,668,933 B2 12/2003 Kent
6,681,860 B1 1/2004 Yokley et al.
6,712,145 B2 3/2004 Allamon
6,712,415 B1 3/2004 Darbishire et al.
6,834,726 B2 12/2004 Giroux et al.
6,866,100 B2 3/2005 Gudmestad et al.
6,896,049 B2 5/2005 Moyes
6,948,561 B2 9/2005 Myron et al.
6,983,795 B2 1/2006 Zuklic et al.
7,150,326 B2 12/2006 Bishop et al.
7,322,408 B2 1/2008 Howlett
7,325,617 B2 2/2008 Murray
7,337,847 B2 3/2008 McGarian et al.
7,350,578 B2 4/2008 Szarka et al.
7,377,321 B2 5/2008 Rytlewski
7,387,165 B2 6/2008 Lopez de Cardenas et al.
7,416,029 B2 8/2008 Telfer et al.
7,467,664 B2 12/2008 Cochran et al.
7,503,390 B2 3/2009 Gomez
7,503,392 B2 3/2009 King et al.
7,520,336 B2 4/2009 Mondelli et al.
7,730,953 B2 6/2010 Casciaro
7,832,472 B2 11/2010 Themig
2001/0007284 A1 7/2001 French et al.
2004/0007365 A1 1/2004 Hill et al.
2005/0061372 A1 3/2005 McGrath et al.
2005/0072572 A1 4/2005 Churchill
2005/0126638 A1 6/2005 Gilbert
2005/0205264 A1 9/2005 Starr et al.
2006/0124310 A1 6/2006 Lopez De Cardenas et al.
2006/0169463 A1 8/2006 Howlett
2006/0175092 A1 8/2006 Mashburn
2006/0213670 A1 * 9/2006 Bishop et al. ..... 166/386
2006/0243455 A1 11/2006 Telfer et al.
2007/0007007 A1 1/2007 Themig et al.
2007/0012438 A1 1/2007 Hassel-Sorensen
2007/0023087 A1 2/2007 Krebs et al.
2007/0095538 A1 5/2007 Szarka et al.
2007/0272413 A1 11/2007 Rytlewski et al.
2008/0066924 A1 3/2008 Xu
2008/0093080 A1 4/2008 Palmer et al.
2008/0190620 A1 8/2008 Posevina et al.
2008/0217025 A1 9/2008 Ruddock et al.
2008/0308282 A1 12/2008 Standridge et al.
2009/0032255 A1 2/2009 Surjaatmadja et al.
2009/0044946 A1 2/2009 Schasteen et al.
2009/0044955 A1 2/2009 King et al.
2009/0056934 A1 3/2009 Xu
2009/0056952 A1 3/2009 Churchill
2009/0107680 A1 4/2009 Surjaatmadja
2009/0159289 A1 6/2009 Avant et al.
2009/0308588 A1 * 12/2009 Howell et al. ..... 166/66.4
2010/0294514 A1 11/2010 Crow et al.
2011/0108284 A1 5/2011 Flores et al.
2011/0180274 A1 7/2011 Wang et al.

OTHER PUBLICATIONS

International Search Report; PCT/US2010/033737; Korean Intellectual Property Office; Mailed Jan. 24, 2011.
International Search Report; Date of Mailing Jan. 24, 2011; International Appln No. PCT/US2010/034736; 3 Pages.
International Search Report; Date of Mailing Jan. 24, 2011; Internatiaonal Appln. No. PCT/US2010/034735; 3 Pages.
Nternational Search Report and Written Opinion; Date of Mailing Feb. 11, 2011; International Appln No. PCT/US2010/041049; International Search Report 5 Pages and Written Opinion 3 Pages.
International Search Report; PCT/US2010/044399; International Searching Authority KIPO; Mailed Mar. 21, 2011.
Notification of Transmittal of the International Search Report and the Written Opinion of the International Searching Authority; PCT/US2010/054487; International Searching Authority; KIPO; Mailed Jun. 3, 2011.
Notification of Transmittal of the International Search Report and the Written Opinion of the International Searching Authority; PCT/US2010/049810; International Searching Authority KIPO; Mailed Apr. 25, 2011.
Notification of Transmittal of the International Search Report and the Written Opinion of the International Searching Authority; PCT/US2010/044856; Mailed Apr. 15, 2011.
Notification of Transmittal of the International Search Report and the Written Opinion of the International Searching Authority; PCT/US2010/044383; Mailed Apr. 15, 2011.
International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.
Response to Office Action dated Oct. 15, 2008, in U.S. Appl. No. 11/891,713, U.S. Patent and Trademark Office, U.S.A.
Office Action dated Jun. 25, 2009, in U.S. Appl. No. 11/891,714, USPTO, U.S.A.
Office Action dated Jun. 19, 2009, in U.S. Appl. No. 11/891,715, U.S. Patent and Trademark Office, U.S.A.
Response to Restriction Requirement dated Apr. 22, 2009 in U.S. Appl. No. 11/891,715, U.S. Patent and Trademark Office, U.S.A.
Office Action dated Apr. 9, 2009, in U.S. Appl. No. 11/891,715, U.S. Patent and Trademark Office, U.S.A.

Notice of Allowance & Fees Due and Notice of Allowability dated Jan. 5, 2009, in U.S. Appl. No. 11/891,713, U.S. Patent and Trademark Office, U.S.A.
Office Action dated Jul. 16, 2008 in U.S. Appl. No. 11/891,713 U.S. Patent and Trademark Office, U.S.A.
International Search Report, Feb. 11, 2009 pp. 1-3, PCT/US2008/072732, Korean Intellectual Property Office.
Notification of Transmittal of the International Search Report and the Written Opinion of the International Searching Authority, or the Declaration, Feb. 11, 2009, pp. 1-4, PCT/US2008/072732, Korean Intellectual Property Office.
Notification of Transmittal of the International Search Report and the Written Opinion of the International Searching Authority, or the Declaration, Feb. 11, 2009, pp. 1-4, PCT/US2008/072734, Korean Intellectual Property Office.
Written Opinion of the International Searching Authority, Feb. 11, 2009, pp. 1-3, PCT/US2008/072732, Korean Intellectual Property Office.
Written Opinion of the International Searching Authority, Feb. 11, 2009, pp. 1-4, PCT/US2008/072734, Korean Intellectual Property Office.
International Search Report, Feb. 11, 2009, pp. 1-3, PCT/US2008/072734, Korean Intellectual Property Office.
International Search Report, Feb. 11, 2009, pp. 1-3, PCT/US2008/072735, Korean Intellectual Property Office.
Notification of Transmittal of the International Search Report and the Written Opinion of the International Searching Authority, or the Declaration, Feb. 11, 2009, pp. 1-4, PCT/US2008/072735, Korean Intellectual Property Office.
Notification of Transmittal of the International Search Report and the Written Opinion of the International Searching Authority, or the Declaration, Jan. 19, 2009, pp. 1-4, PCT/US2008/072470, Korean Intellectual Property Office.
Written Opinion of the International Searching Authority, Feb. 11, 2009, pp. 1-4, PCT/US2008/072735, Korean Intellectual Property Office.
Written Opinion of the International Searching Authority, Jan. 19, 2009, pp. 1-3, PCT/US2008/072470, Korean Intellectual Property Office.
International Search Report, Jan. 19, 2009, pp. 1-3, PCT/US2008/072470, Korean Intellectual Property Office.
Baker Hughes, Baker Oil Tools, Conventional Fishing Technical Unit; Pump Out Sub Product Family No. H14061, Jun. 7, 2005, 1 page.
Ross, C. M., et al., "Current Materials and Devices for Control of Fluid Loss," SPE 54323, Apr. 1999, pp. 1-16.
Hoffman, C.R., "One-Trip Sand-Control/Liner Hangar/ Big-Bore Completion System," SPE 101086, Sep. 2006, pp. 1-10.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Boscan, J., et al., "Successful Well Testing Operations in High-Pressure/High-Temperature Encironment; Case Histories," SPE 84096, Oct. 2003, pp. 1-15.
Brad Musgrove, Multi-Layer Fracturing Solution Treat and Produce Completions, Nov. 12, 2007, pp. 1-23, Schlumberger, U.S.A.
RFID Keystone Module, RFID & Intelligent Products, Petrowell retrieved online on May 27, 2009 from: http://www.petrowell.co.uk/index2.php?option=com_docman&task=doc_view&gid=15&Itemid=26.
StageFRAC Maximize Reservoir Drainage, 2007, pp. 1-2, Schlumberger, U.S.A.
TAP Completion System, Schlumberger, 4 pages, Dec. 2007.
Notification of Transmittal of the International Search Report and the Written Opinion of the International Searching Authority; PCT/US2011/041663; Korean Intellectual Property Office; Mailed Dec. 14, 2011; 8 pages.

* cited by examiner 10
14
12
20
16
28
18
22
24
30
32
36
38
34
44
40
42

PLUG COUNTER AND METHOD

BACKGROUND

In the Drilling and completion industries it is often desirable to affect tools or formations at a great distance from a surface located facility such as a rig. One example of an operation intended to affect a formation is a fracturing operation. In order to perform such an operation, hydraulic pressure is built within a tubing string until the pressure exceeds formation capability for holding that pressure and fractures form in the formation. This type of operation is most effective if done in small incremental sections of a borehole for reasons related to control and distribution of fractures to serve the ultimate purpose of the borehole. Such purposes include hydrocarbon production, Carbon Dioxide sequestration, etc.

In the art, fracturing discrete locations of the borehole tends to require a number of tools related to the pressuring of discrete locations. Such tools increase expense initially and generally create other issues to be overcome after the fracturing process is complete such as removal of the tools that enabled the pressuring of a discrete location. Where multiple fracturing locations are contemplated, generally a staged system must be built and administered correctly for it to work. One such system uses progressively larger seat diameters from the toe back to surface and then progressively increasing diameter balls. While the system works well, it is limited by the number of different size balls that can be used. Tolerance is also required in any system (due to such things as irregular shape of tubing secondary to borehole irregularity), which therefore further limits the number of diameters usable in a particular system.

Since fracturing and other operations where it is desirable to isolate discrete locations continue to become more prevalent and ubiquitous, alternate systems for accessing and manipulating the downhole environment is always well received.

SUMMARY

A plug counter including a j-slot sleeve; a helix sleeve in operable communication with the j-slot sleeve such that axial movement of the j-slot sleeve causes rotational movement of the helix sleeve; an anti-rotation sleeve disposed about the helix sleeve and having a keyway therein; and a key disposed in the keyway and responsive to movement of the helix sleeve.

A downhole tool including a housing having a support and one or more plug passage recesses; a movable plug seat positionable to be supported by the support or aligned with the recess; a j-slot sleeve connected to the movable plug seat and having a j-slot thereon; a helix sleeve responsive to movement of the j-slot sleeve; and a key responsive to movement of the helix sleeve and configured to prevent further movement of the foregoing components after a selected number of movable plug seat movements.

A system for performing multiple actuations in a borehole using a single size plug including; one or more downhole tools including: a housing having a support and one or more plug passage recesses; a movable plug seat positionable to be supported by the support or aligned with the recess; a j-slot sleeve connected to the movable plug seat and having a j-slot thereon; a helix sleeve responsive to movement of the j-slot sleeve; a key responsive to movement of the helix sleeve and configured to prevent further movement of the foregoing components after a selected number of movable plug seat movements; and a plurality of plugs runnable in the borehole and seatable in the movable plug seat.

A method for performing multiple actuations in a borehole using a single size plug including deploying one of a plurality of plugs into the borehole; counting the plug with a downhole tool; and automatically selecting one of passing the plug or denying passage of the plug depending upon the count.

BRIEF DESCRIPTION OF THE DRAWINGS

Referring now to the drawings wherein like elements are numbered alike in the several Figures.

DETAILED DESCRIPTION

Referring to FIGS. 1-4, a plug counter tool 10 is illustrated in longitudinal cross section in four different positions to make apparent not only its structural constituents but its operation as well. It is initially noted that the term "plug" as used herein is intended to encompass tripping balls, darts, and similar structures that can be propagated through a borehole and/or tubing string to reach remote locations therewithin. The plug counter tool embodiments disclosed herein facilitate the use of a single size plug (or fewer sizes, if desired, in a particular application) for multiple actuation sequences. For example, where multiple fracture points are desired in a borehole, traditional fracturing would require a number of different diameter plugs used sequentially from smaller to larger as operations progress up the hole. With the tool embodiments described herein only one size plug is needed.

Figures 1, 2, 3, 4:
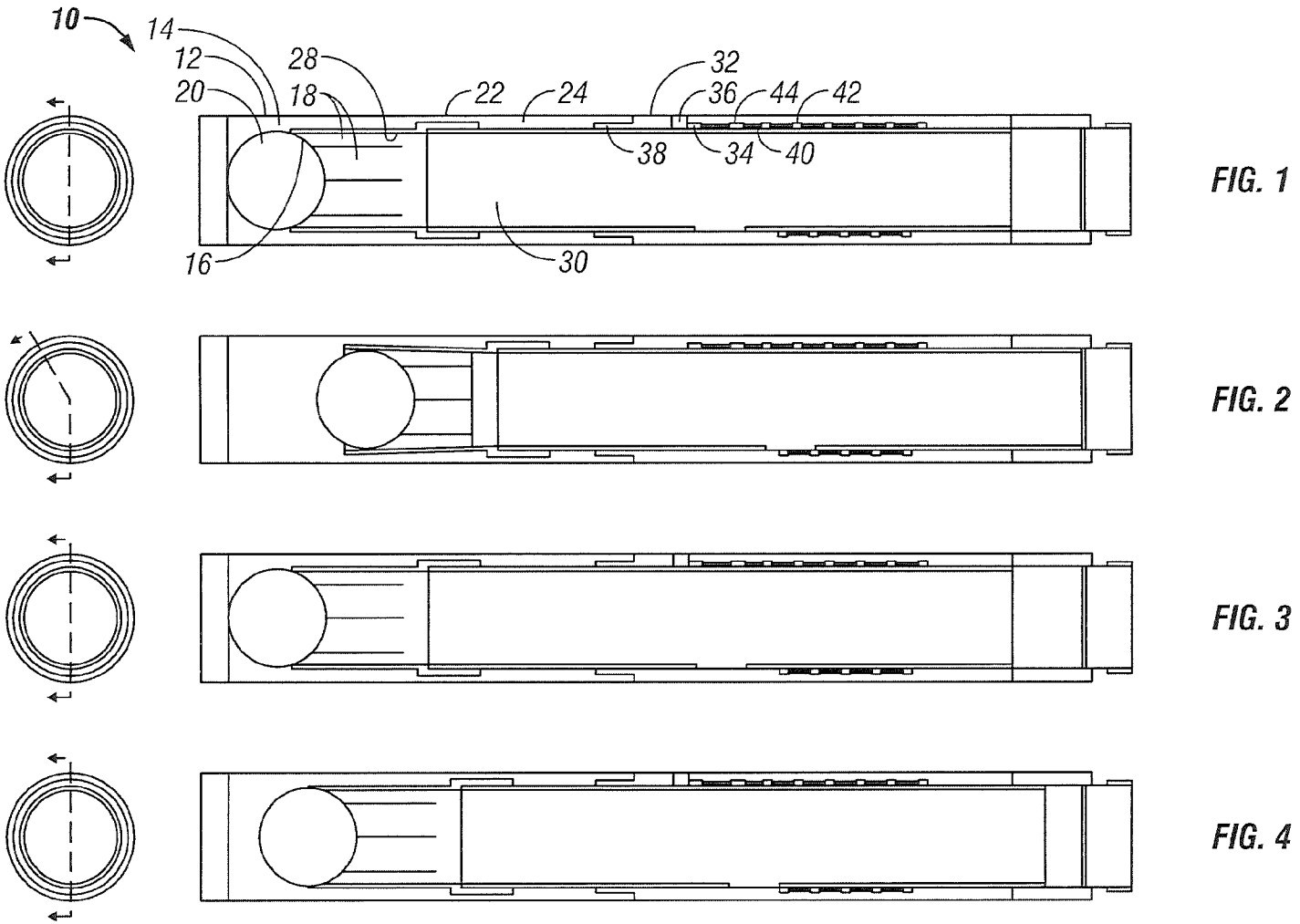
FIGS. 1-4 illustrate a cross sectional view of one embodiment of the tool disclosed herein in four different positions.

Referring directly to FIG. 1, an outer housing 12 includes a support 14 to support a moveable plug seat 16, which in the case of FIG. 1 is presented by a set of collet fingers 18. The support 14 and movable seat 16 operate together to catch a plug 20 after which the plug is passed or denied passage as discussed hereunder. The fingers 18 are supported by support 14 while the collet fingers are in the position shown in FIG. 1. Support for the fingers 18 is dependent upon the position of collet 22, which is dependent upon the ability of a spring 24 to hold the collet 22 in the position shown in FIG. 1. More specifically, when a plug is seated in the seat 16 pressure can and will in operation be built uphole of the plug. The spring rate of the spring 24 selected dictates the amount of fluid pressure that can be resisted before the collet 22 moves in a downhole direction and the fingers 18 become unsupported. The spring 24 is a compression spring and as illustrated is a coil spring. It will hold the collet 22 in the illustrated position until a plug 20 engages the seat 16 and sufficient fluid pressure uphole of the plug overcomes the spring force of spring 24 and compresses the same. As the spring 24 is overcome by fluid pressure, the collet 22 moves in a downhole direction (to the right in the Figure) and moves the fingers 18 off of the support 14. Just downhole of the support 14 is a plug passage recess 28 that will allow radial expansion of the fingers 18 (see FIG. 2) by an amount sufficient to allow passage of the plug 20 through the seat 16. After passage of the plug, fluid pressure equalizes across the seat 16 and the collet 22 returns to the position of FIG. 1 under the bias of the spring 24.

Connected to the collet 22 is j-slot sleeve 30. Sleeve 30 moves axially of the tool 10 along with the collet 22. At a downhole end of the housing 12, an anti-rotation sleeve 32 is attached to the housing. Sleeve 32 does not move relative to housing 12 in any way once the tool is assembled. Anti-rotation sleeve 32 includes one or more pin openings 34 into which one or more pins 36 will be individually inserted. Each pin 36 will thus be fixed to the anti-rotation sleeve 32 and extend into an alignment groove 38 of which there will be one or more in the j-slot sleeve 30. The one or more pins 36 and respective alignment grooves 38 ensure that the j-slot sleeve 30 is not rotatable but is permitted to move only axially during operation of the tool 10. Upon movement of the collet 22 induced by fluid pressure uphole of plug 20 as described above, the j-slot sleeve 30 will cycle back and forth axially of the tool 10.

Radially inwardly of the anti-rotation sleeve 32 and rotatable relative thereto is a helix sleeve 40 exhibiting a helical track 42 at an outside surface thereof The helix sleeve 40 includes one or more j-slot followers 44 (one shown), which may be a part of the helix sleeve 40 or may be a separate component that is engaged with the helix sleeve 40. In either event, the j-slot follower(s) 44 are configured to contact angled surfaces 46 and 48 of a j-slot 50 (see FIG. 5) disposed at the j-slot sleeve 30 upon axial movement of the j-slot sleeve 30. Because followers 44 are fixed to the helix sleeve 40, the helix sleeve 40 will move rotationally about the j-slot sleeve 30 as the followers 44 move along each angled surface 46 or 48. The impetus for this movement is the axial cycling of the j-slot sleeve 30 as described above. Each time a plug 20 lands at the seat 16, thereby allowing pressure to build from uphole against the plug 20, and hence urging the collet 22 to a position aligning the fingers 18 with recess 28, the followers 44 will contact and slide along one of the angled surfaces 46. This will cause a measured rotation of the helix sleeve 40. Because the spring 24 is compressed during this pressure induced axial movement, energy is stored that will be used to urge the followers 44 along the next adjacent angled surface 48 pursuant to the j-slot sleeve 30 moving uphole under spring bias, causing another measured rotation of the helix sleeve 40. The spring 24 induces such movement only after the plug 20, against which fluid pressure had been applied, is released.

Figure 5:
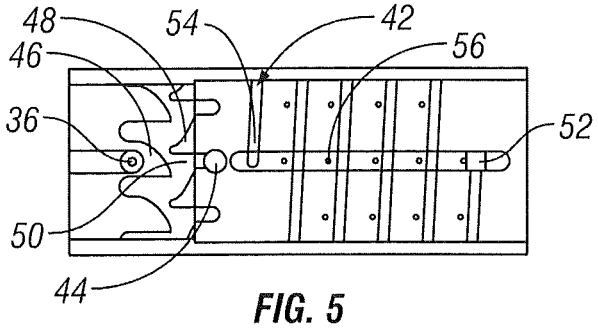
FIGS. 5-8 illustrate in partial transparent view a counter portion of the tool disclosed herein in four different positions corresponding to the positions shown in FIGS. 1-4.
Figure 6:
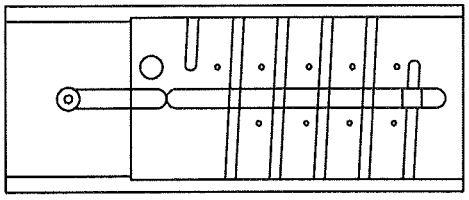
Figure 7:
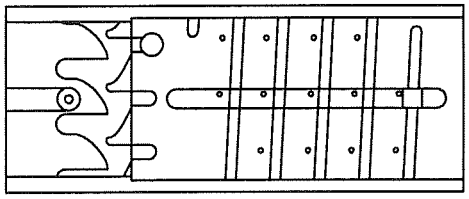
Figure 8:
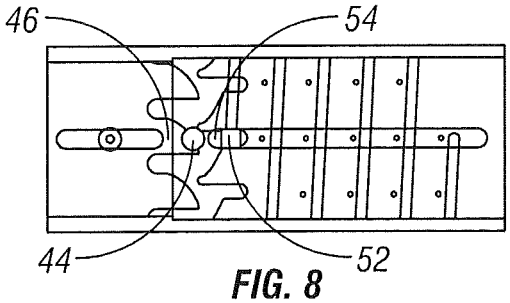

As the helix sleeve 40 rotates, a key 52 that is engaged with the helical track 42 moves leftwardly in the drawing closer to an end 54 of a keyway 56. It is to be appreciated that although the illustrated embodiment moves in an uphole direction, the tool 10 can easily be configured to allow movement of the key 52 in a downhole direction by reversing the helix angle of the helical track 42 and reversing the surface angles of surfaces 46 and 48. As illustrated in FIGS. 1 and 5, the key 52 is in a position that will allow the greatest number of plugs to pass before preventing passage of the next plug to be seated. FIGS. 4 and 8 show the key in the position where the next plug to seat will not pass.

As configured the tool 10 will pass a number of plugs and then prevent further passage of plugs because the helix sleeve 40 is prevented from rotating by the contact between key 52 and an end 54 of keyway 56. The prevention of rotation of the helix sleeve 40 correspondingly prevents the j-slot sleeve 30 from cycling downhole sufficiently to allow the fingers 18 to reach the recess 28. Consequently the plug 20 cannot pass. This position is illustrated best in FIG. 8 where key 52 is at end 54 and follower 44 is at surface 46 but it cannot slide on surface 46 because the key will no longer allow rotation of the helix sleeve 40 due to having run out of helical track 42. It is to be understood, then, that the maximum number of plugs that are passable through tool 10 are fixed by design during manufacture by the length of the helical track 42 and the keyway 56. This is not to say however that this maximum number of plugs is the only number of plugs that will be passable before a plug is denied passage. Rather, because the key is placable in the keyway 56 as the tool is being run into the hole, at any point on the helical track 42 that is exposed to the keyway 56, any number from the maximum number down to a single plug may be selected.

More specifically, the key 52 is a component of the tool 10 that is removable and replaceable at any point along the keyway 56 where the helical track 42 crosses the keyway 56. The helix sleeve 40 itself may be marked to show how many plugs will pass before denying passage to make it a simple operation in the field for a rig worker to place the key in the keyway 56 to select a number of plug passages to facilitate a particular operation. It should be noted that because of the high pressures generally encountered in the wellbore for operations related to seating plugs and the potential operations that might be effected by pressuring up on such a plug, for example fracturing at about 10,000 psi, the key 52 should be robust in size and construction as it is, in the end, the key that stops movement of the balance of the components.

Another feature of the tool 10 is that if for any reason, after plug passage has been denied, it is necessary to pass the denied plug, the follower(s) 44 may be released by, for example, shearing and the collet will be able to move to the recess 28 allowing the plug to pass. This is accomplished by pressuring up higher on the tubing to greater than a threshold pressure that is set prior to running the tool 10 in the hole by the number and strength of the followers 44 employed in the tool 10. Thereafter all plugs will pass and no further counting will be possible with the tool 10 without removal thereof from the hole and replacement of one or more followers 44.

Figure 9:
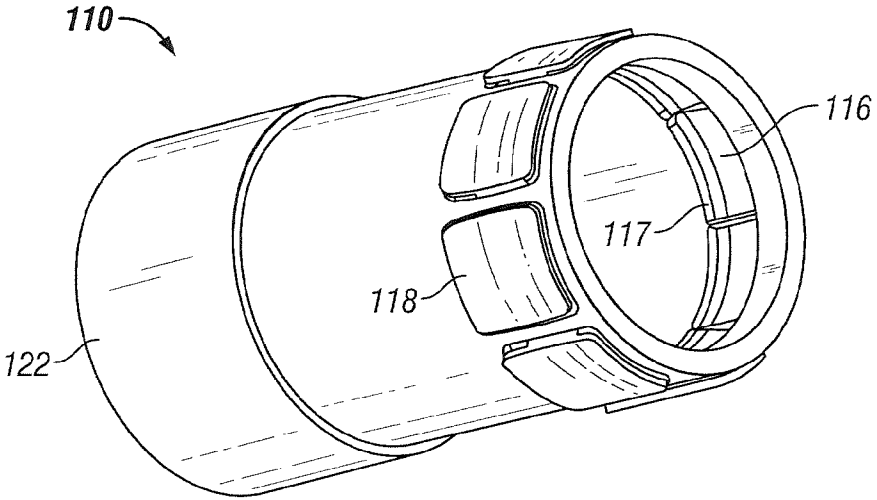
FIG. 9 is a perspective view of an alternate moveable seat substitutable in the tool.
Figure 10:
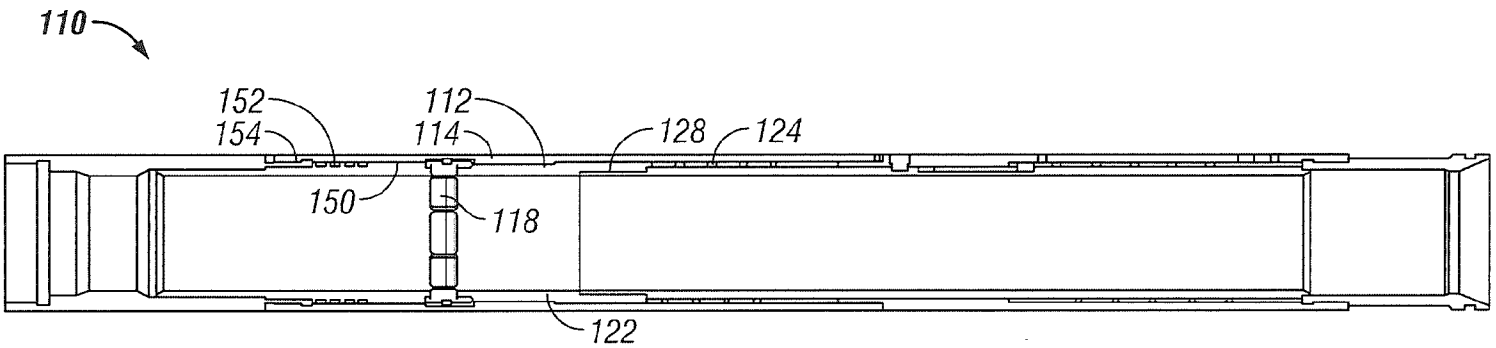
FIG. 10 is a schematic view of a portion of an alternate housing of the tool 10 shown in FIG. 1.

Referring to FIGS. 9 and 10, an alternate embodiment of the tool disclosed above is illustrated. The embodiment operates similarly to the tool 10 and identically operating components are not discussed again. The tool is distinct in that a dog-based seat structure 122, having a plug seat 116, is substituted for the collet 22 in the FIG. 1 embodiment. For clarity, numerals are mimicked in the 100 series. In normal operation the dogs function, as do the fingers 18 from the previous embodiment. The housing 112 is also distinct in that an additional plug passage recess 150 is provided uphole of the support 114 so that in reverse flow, the one or more dogs 118 can be moved into alignment with the recess 150 to allow passage of one or more plugs in the uphole direction as part of a reverse circulation operation to remove the plugs from the borehole. In order for the structure 122 to move uphole, a plug that had been passed in normal operation of the tool 110 is moved in reverse circulation into a seat 117 on the backside of seat 116. The pressure of reverse circulation acts on the plug in the same manner as in the original operation but in the opposite direction. A spring 152 is disposed uphole of the structure 122 and will be compressed against a top sub 154 at a selected force from fluid pressure on the plug. Movement of the structure 122 in the uphole direction mirrors that of movement in the downhole direction and aligns the dogs 118 with the recess 128, which allows the plug to pass. While an embodiment could eliminate spring 152 and simply allow the structure 122 to stay in the uphole position, including the spring 152 provides the added benefit that the device will automatically revert to a functional state after passage of the plug in the uphole direction so that normal operation of the tool 110 could be resumed if desired.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole tool comprising:

a housing having a support and one or more plug passage recesses;

a movable plug seat positionable to be supported by the support or aligned with the recess;

a j-slot sleeve connected to the movable plug seat and having a j-slot thereon;

a helix sleeve responsive to movement of the j-slot sleeve, the sleeve having a helical track thereon; and a key responsive to movement of the helix sleeve and configured to prevent further movement of the foregoing components after a selected number of movable plug seat movements.

2. A downhole tool as claimed in claim 1 wherein the movable plug seat is a collet.

3. A downhole tool as claimed in claim 1 wherein the movable plug seat is a dog-based structure.

4. A downhole tool as claimed in claim 3 wherein the structure presents seats in two axial directions.

5. A downhole tool as claimed in claim 1 wherein the helix sleeve includes one or more followers positionally fixed to the helix sleeve and in engagement with the j-slot.

6. A downhole tool as claimed in claim 5 wherein the one or more followers are releasable.

7. A downhole tool as claimed in claim 5 wherein the one or more followers are shearable.

8. A downhole tool as claimed in claim 1 wherein the key is engagable with the helical track at any position thereon that intersects a keyway.

9. A downhole tool as claimed in claim 1 wherein the one or more plug passage recesses includes a plug passage recess uphole of the support to allow reverse circulation of plugs out of a borehole in which the tool is disposed.

10. A method for performing multiple actuations in a borehole using a single size plug comprising:

deploying one of a plurality of plugs into the borehole;

counting the plug with a downhole tool having a helix sleeve with a helical track therein, the helical track having a plurality of consecutive turns encircling the helix sleeve;

placing a key in a position on the helical track associated with a selected number of counts for plug passage prior to denying further plug passage and automatically selecting one of passing the plug or denying passage of the plug depending upon the count.

11. A method for performing multiple actuations in a borehole using a single size plug as claimed in claim 10 wherein the actuations are fracturing procedures.

12. A method for performing multiple actuations in a borehole using a single size plug as claimed in claim 10 wherein the counting is by seating a plug in a movable plug seat;

pressuring on the plug;

cycling a j-slot sleeve having a j-slot thereon;

rotating the helix sleeve responsive to the j-slot; and advancing the key within a keyway responsive to the rotating of the helix sleeve.

13. A method for performing multiple actuations in a borehole using a single size plug as claimed in claim 10 wherein the count is dictated by key position within the keyway.

14. A method for performing multiple actuations in a borehole using a single size plug as claimed in claim 10 wherein the method further includes releasing the tool to allow further plug passage.

15. A method for performing multiple actuations in a borehole using a single size plug comprising:

deploying one of a plurality of plugs into the borehole;

counting the plug with a downhole tool having a helix sleeve with a helical track therein wherein the counting includes placing a j-slot follower of the helix sleeve within a j-slot of a j-slot sleeve;

placing a key in a position on the helical track associated with a selected number of counts for plug passage prior to denying further plug passage and automatically selecting one of passing the plug or denying passage of the plug depending upon the count.

* * * * *